US008627606B2

(12) United States Patent
Salerno et al.

(10) Patent No.: US 8,627,606 B2
(45) **Date of Patent: *Jan. 14, 2014**

(54) COMBINED SEALING SYSTEM FOR GARAGE DOOR

(75) Inventors: Don S. Salerno, Hollywood, FL (US); W. Kip Speyer, Boca Raton, FL (US)

(73) Assignee: Tyto Life LLC, Kent County, DE (US)

( * ) Notice: Subject to any disclaimer, the term of this patent is extended or adjusted under 35 U.S.C. 154(b) by 810 days.

This patent is subject to a terminal disclaimer.

(21) Appl. No.: 12/414,948

(22) Filed: Mar. 31, 2009

(65) Prior Publication Data

US 2009/0178344 A1 Jul. 16, 2009

Related U.S. Application Data

(63) Continuation-in-part of application No. 11/846,139, filed on Aug. 28, 2007, and a continuation-in-part of application No. 11/322,952, filed on Dec. 30, 2005, now Pat. No. 7,685,775, and a continuation-in-part of application No. 11/756,957, filed on Jun. 1, 2007, and a continuation-in-part of application No. 11/425,377, filed on Jun. 20, 2006, now Pat. No. 7,624,539.

(60) Provisional application No. 61/101,542, filed on Sep. 30, 2008.

(51) Int. Cl.
*E06B 7/18* (2006.01)

(52) U.S. Cl.
USPC ..... 49/319; 49/316; 49/317; 49/318; 49/320; 49/303; 49/304; 49/197

(58) Field of Classification Search
USPC ..... 49/316–321, 303, 304, 501, 404, 197; 160/201, 40
See application file for complete search history.

(56) References Cited

U.S. PATENT DOCUMENTS

| | | | |
|---|---|---|---|
| 19,217 | A | 1/1858 | Tinney |
| 313,742 | A | 3/1885 | Kintner |
| 703,889 | A | 7/1902 | Berry |
| 724,139 | A | 3/1903 | Smith |
| 918,213 | A | 4/1909 | Specht |

(Continued)

OTHER PUBLICATIONS

Dictionary.com, "Active," retrieved online at: http://dictionary.reference.com/browse/active (2010).

(Continued)

*Primary Examiner* — Katherine Mitchell
*Assistant Examiner* — Marcus Menezes
(74) *Attorney, Agent, or Firm* — Nelson Mullins Riley & Scarborough LLP; Anthony A. Laurentano

(57) ABSTRACT

A combined sealing system comprises a frame, a panel, a first sealing system, a second sealing system, and a third sealing system. The panel is within and movable, relative to the frame, between at least an open position and a completely closed position, and the panel includes a plurality of subpanels hinged relative to one another. The first sealing system is configured to engage a sill rail of the panel with a sill of the frame. The second sealing system is configured to engage a stile rail of the panel with a jamb of the frame. The third sealing system is configured to engage a meeting rail of the first panel with a header of the frame. In the closed position, the first and second sealing systems movable between a locked configuration and an unlocked configuration.

6 Claims, 17 Drawing Sheets

(56) References Cited

U.S. PATENT DOCUMENTS

| | | | | | |
|---|---|---|---|---|---|
| 946,305 | A | | 1/1910 | Abbott | |
| 966,939 | A | | 8/1910 | Mitchell | |
| 982,828 | A | | 1/1911 | Kelly | |
| 1,009,978 | A | | 11/1911 | Knappe | |
| 1,021,862 | A | | 4/1912 | Culver | |
| 1,170,101 | A | | 2/1916 | Pullets | |
| 1,178,775 | A | | 4/1916 | Albright | |
| 1,265,478 | A | * | 5/1918 | Montgomery | 49/318 |
| 1,345,967 | A | | 7/1920 | Smelser | |
| 1,468,958 | A | | 9/1923 | Champion | |
| 1,489,018 | A | | 4/1924 | Shultz | |
| 1,675,230 | A | | 6/1928 | Snyder | |
| 1,715,188 | A | | 5/1929 | Bullock | |
| 1,716,764 | A | | 6/1929 | Carrigan | |
| 1,797,839 | A | | 3/1931 | Ramsay | |
| 1,974,269 | A | | 9/1934 | Gonder | |
| 1,977,726 | A | | 10/1934 | Jacobson | |
| 1,993,506 | A | | 3/1935 | Fauner | |
| 1,995,939 | A | | 3/1935 | Osten | |
| 2,065,590 | A | | 12/1936 | Jennings | |
| 2,207,065 | A | | 7/1940 | McCormick | |
| 2,248,719 | A | | 7/1941 | Owen | |
| 2,268,114 | A | | 12/1941 | Foster | |
| 2,541,421 | A | | 2/1951 | Hunter | |
| 2,552,369 | A | | 5/1951 | Currie | |
| 2,593,093 | A | | 4/1952 | Bjork | |
| 2,628,678 | A | | 2/1953 | Webster | |
| 2,663,056 | A | | 12/1953 | Hardgrave | |
| 2,719,342 | A | * | 10/1955 | Hunt | 49/318 |
| 2,753,020 | A | * | 7/1956 | Ware, Jr. | 49/318 |
| 2,763,038 | A | * | 9/1956 | Hagerty et al. | 49/390 |
| 2,766,860 | A | * | 10/1956 | Travis | 49/318 |
| 2,805,451 | A | | 9/1957 | Evans | |
| 2,837,151 | A | | 6/1958 | Stroup | |
| 2,862,256 | A | * | 12/1958 | Stroup | 160/191 |
| 2,862,262 | A | | 12/1958 | Shea | |
| 2,928,144 | A | | 3/1960 | Persson | |
| 3,004,309 | A | | 10/1961 | Karodi | |
| 3,054,152 | A | | 9/1962 | Trammell | |
| 3,059,287 | A | | 10/1962 | Baruch | |
| 3,070,856 | A | | 1/1963 | Minick | |
| 3,077,644 | A | | 2/1963 | Kesling | |
| 3,098,519 | A | | 7/1963 | Myers | |
| 3,111,727 | A | | 11/1963 | Gerecke | |
| 3,126,051 | A | | 3/1964 | Sussin | |
| 3,161,229 | A | * | 12/1964 | Sanders | 160/40 |
| 3,163,891 | A | | 1/1965 | Seliger | |
| 3,184,806 | A | | 5/1965 | Bragman | |
| 3,252,255 | A | | 5/1966 | Marpe | |
| 3,289,377 | A | | 12/1966 | Hetman | |
| 3,295,257 | A | | 1/1967 | Douglass | |
| 3,335,524 | A | | 8/1967 | Carson | |
| 3,374,821 | A | | 3/1968 | White | |
| 3,383,801 | A | | 5/1968 | Dallaire | |
| 3,466,801 | A | | 9/1969 | Bohn | |
| 3,512,303 | A | | 5/1970 | Wright | |
| 3,590,530 | A | | 7/1971 | Duguay | |
| 3,590,531 | A | | 7/1971 | Childs | |
| 3,660,936 | A | | 5/1972 | Bryson | |
| 3,660,940 | A | | 5/1972 | Tavano | |
| 3,816,966 | A | | 6/1974 | Sause, Jr. | |
| 3,818,636 | A | | 6/1974 | Calais et al. | |
| 3,821,884 | A | | 7/1974 | Walsh | |
| 3,848,908 | A | | 11/1974 | Rich | |
| 3,857,199 | A | | 12/1974 | Frach et al. | |
| 3,910,155 | A | | 10/1975 | Wilson | |
| 3,959,927 | A | | 6/1976 | Good | |
| 4,018,022 | A | | 4/1977 | Fink | |
| 4,027,431 | A | | 6/1977 | Rackard | |
| 4,064,651 | A | | 12/1977 | Homs | |
| 4,128,967 | A | | 12/1978 | Kirsch | |
| 4,170,846 | A | | 10/1979 | Dumenil et al. | |
| 4,307,542 | A | | 12/1981 | Lense | |
| 4,317,312 | A | | 3/1982 | Heideman | |
| 4,322,914 | A | | 4/1982 | McGaughey | |
| 4,392,329 | A | | 7/1983 | Suzuki | |
| 4,413,446 | A | | 11/1983 | Dittrich | |
| 4,453,346 | A | | 6/1984 | Powell et al. | |
| 4,479,330 | A | | 10/1984 | Muller | |
| 4,496,942 | A | | 1/1985 | Matsuoka | |
| 4,535,563 | A | | 8/1985 | Mesnel | |
| 4,614,060 | A | | 9/1986 | Dumenil et al. | |
| 4,643,239 | A | * | 2/1987 | Wentzel | 160/201 |
| 4,656,779 | A | | 4/1987 | Fedeli | |
| 4,656,799 | A | | 4/1987 | Maryon | |
| 4,716,693 | A | | 1/1988 | Webster | |
| 4,765,105 | A | | 8/1988 | Tissington et al. | |
| 4,768,316 | A | | 9/1988 | Haas | |
| 4,831,509 | A | | 5/1989 | Jones et al. | |
| 4,837,560 | A | | 6/1989 | Newberry | |
| 4,870,909 | A | | 10/1989 | Richter | |
| 4,936,049 | A | | 6/1990 | Hansen | |
| 5,007,202 | A | | 4/1991 | Guillon | |
| 5,020,292 | A | | 6/1991 | Strom et al. | |
| 5,029,911 | A | | 7/1991 | Daniels | |
| 5,030,488 | A | | 7/1991 | Sobolev | |
| 5,187,867 | A | | 2/1993 | Rawlings | |
| 5,293,726 | A | | 3/1994 | Schick | |
| 5,327,684 | A | | 7/1994 | Herbst | |
| 5,339,881 | A | | 8/1994 | Owens | |
| 5,349,782 | A | | 9/1994 | Yulkowski | |
| 5,379,518 | A | | 1/1995 | Hopper | |
| 5,446,997 | A | | 9/1995 | Simonton | |
| 5,467,559 | A | | 11/1995 | Owens | |
| 5,479,151 | A | | 12/1995 | Lavelle et al. | |
| 5,511,833 | A | | 4/1996 | Tashman et al. | |
| 5,521,585 | A | | 5/1996 | Hamilton | |
| 5,522,180 | A | | 6/1996 | Adler et al. | |
| 5,522,195 | A | | 6/1996 | Bargen | |
| 5,569,878 | A | | 10/1996 | Zielinski | |
| 5,584,142 | A | | 12/1996 | Spiess | |
| 5,605,013 | A | | 2/1997 | Hogston | |
| 5,638,639 | A | | 6/1997 | Goodman et al. | |
| 5,784,834 | A | | 7/1998 | Stutzman | |
| 5,786,547 | A | | 7/1998 | Zielinski | |
| 5,848,630 | A | * | 12/1998 | Manzo | 160/113 |
| 5,870,859 | A | | 2/1999 | Kitada | |
| 5,870,869 | A | | 2/1999 | Schrader | |
| 5,964,060 | A | | 10/1999 | Furlong | |
| 6,041,552 | A | | 3/2000 | Lindahl | |
| 6,057,658 | A | | 5/2000 | Kovach et al. | |
| 6,061,967 | A | * | 5/2000 | Judds | 49/469 |
| 6,082,047 | A | | 7/2000 | Comaglio et al. | |
| 6,105,313 | A | | 8/2000 | Holloway et al. | |
| 6,112,466 | A | | 9/2000 | Smith et al. | |
| 6,112,467 | A | | 9/2000 | Bark et al. | |
| 6,112,496 | A | | 9/2000 | Hugus et al. | |
| 6,119,307 | A | * | 9/2000 | Weishar et al. | 16/87 R |
| 6,170,195 | B1 | | 1/2001 | Lim | |
| 6,173,533 | B1 | | 1/2001 | Cittadini et al. | |
| 6,181,089 | B1 | | 1/2001 | Kovach et al. | |
| 6,202,353 | B1 | | 3/2001 | Giacomelli | |
| 6,218,939 | B1 | | 4/2001 | Peper | |
| 6,243,999 | B1 | | 6/2001 | Silverman | |
| 6,289,643 | B1 | | 9/2001 | Bonar | |
| 6,318,037 | B1 | | 11/2001 | Hansen | |
| 6,442,899 | B1 | | 9/2002 | Gledhill | |
| 6,490,832 | B1 | | 12/2002 | Fischbach et al. | |
| D470,252 | S | | 2/2003 | Castrey | |
| 6,546,682 | B1 | | 4/2003 | DeBlock et al. | |
| 6,553,735 | B1 | | 4/2003 | Chen | |
| 6,568,131 | B1 | | 5/2003 | Milano, Jr. | |
| 6,619,005 | B1 | | 9/2003 | Chen | |
| 6,644,884 | B2 | | 11/2003 | Gledhill | |
| 6,651,389 | B2 | | 11/2003 | Minter et al. | |
| 6,772,818 | B2 | | 8/2004 | Whitley et al. | |
| 6,786,005 | B1 | | 9/2004 | Williams | |
| 6,871,902 | B2 | | 3/2005 | Carson et al. | |
| 6,973,753 | B2 | | 12/2005 | Liebscher | |
| 7,010,888 | B2 | | 3/2006 | Tumlin et al. | |
| 7,124,538 | B1 | | 10/2006 | Kline | |
| 7,145,436 | B2 | | 12/2006 | Ichikawa et al. | |
| 7,185,468 | B2 | | 3/2007 | Clark et al. | |
| 7,487,616 | B2 | | 2/2009 | Deaver | |

(56) References Cited

U.S. PATENT DOCUMENTS

| | | | | |
|---|---|---|---|---|
| 7,566,035 | B2 | 7/2009 | Bonshor | |
| 7,624,539 | B2 | 12/2009 | Speyer et al. | |
| 7,627,987 | B2 | 12/2009 | Thielmann et al. | |
| 7,665,245 | B2 | 2/2010 | Speyer et al. | |
| 7,685,774 | B2 | 3/2010 | Thielmann | |
| 7,685,775 | B2 * | 3/2010 | Speyer et al. | 49/411 |
| 7,685,776 | B2 | 3/2010 | Speyer et al. | |
| 7,707,773 | B2 | 5/2010 | Thielmann et al. | |
| 7,719,213 | B2 | 5/2010 | Herman et al. | |
| 8,074,399 | B2 * | 12/2011 | Speyer et al. | 49/318 |
| 8,074,400 | B2 * | 12/2011 | Speyer et al. | 49/318 |
| 8,109,037 | B2 * | 2/2012 | Speyer et al. | 49/318 |
| 2003/0033786 | A1 | 2/2003 | Yulkowski | |
| 2004/0068935 | A1 | 4/2004 | Ichikawa et al. | |
| 2004/0194386 | A1 * | 10/2004 | Albiero | 49/27 |
| 2005/0097842 | A1 | 5/2005 | Arcamonte et al. | |
| 2005/0102908 | A1 | 5/2005 | Martin | |
| 2006/0207199 | A1 | 9/2006 | Darnell | |
| 2007/0289221 | A1 | 12/2007 | Speyer et al. | |
| 2007/0290456 | A1 * | 12/2007 | Speyer et al. | 277/628 |
| 2009/0151259 | A1 | 6/2009 | Speyer et al. | |
| 2009/0165415 | A1 | 7/2009 | Salerno | |
| 2009/0165423 | A1 | 7/2009 | Salerno | |
| 2010/0077665 | A1 | 4/2010 | Speyer et al. | |

OTHER PUBLICATIONS

Patio Life—Operation, retrieved online at: http://www.rotohardware.com/Products/Patio%20Life/PL-Operation.htm (2006).

International Search Report for Application No. PCT/US2010/029383, dated May 25, 2010.

International Search Report for Application No. PCT/US2010/029206, dated Jun. 2, 2010.

* cited by examiner

COMBINED SEALING SYSTEM FOR GARAGE DOOR

CROSS-REFERENCE TO RELATED APPLICATIONS

This application is a Continuation-In-Part of U.S. application Ser. No. 11/846,139, filed on Aug. 28, 2007, which is a Continuation-In-Part of U.S. application Ser. No. 11/322,952, filed on Dec. 30, 2005 and a Continuation-In-Part of U.S. application Ser. No. 11/756,957, filed on Jun. 1, 2007, which is a Continuation-In-Part of U.S. application Ser. No. 11/425,377, filed on Jun. 20, 2006, all of which are incorporated herein by reference in their entirety. This application also claims the benefit of U.S. Provisional Application No. 61/101,542, filed Sep. 30, 2008, which is incorporated herein by reference in its entirety. This application is related to U.S. patent application Ser. No. 12/414,948 filed Mar. 31, 2009 and entitled "SEALING SYSTEMS FOR GARAGE DOOR," which is incorporated herein by reference in its entirety.

BACKGROUND OF THE INVENTION

1. Field of the Invention

The disclosure relates generally to sealing systems for use with panels, such as a door or a window, within a frame and, more specifically, to an active sealing system for providing an improved seal between a panel and frame.

2. Description of the Related Art

Certain types of panels, such as doors and windows, are positioned within openings of a wall and/or other structures using a frame. These panels may also open and close by pivoting relative to the frame. Alternatively, the one or more panel may slide relative to the frame. An issue associated with these types of panels is the integrity of the seals between the panels and the frame. In many instances, these seals are an insufficient barrier in preventing the transfer of such environmental elements as noise, weather, water, and insects from one side of the panel to the other side of the panel.

Attempts have been made to address these issues by using various types of weather stripping between the panels and frame. For example, the weather stripping may be strip of felt, foam, or a pile of flexible synthetic material. In many instances, however, this weather stripping fails to act as a sufficient seal between the panels and frame. Another issue prevalent associated with the seals between a frame and panel or between adjacent panels is that these seals can become disjoined. Either intentionally or unintentionally, the alignment between the frame and panel or between adjacent panels may be disturbed which can degrade the quality of the seal, since, in many instances, the integrity of the seal relies upon these members having certain positional relationships relative to one another.

Another issue associated with the movement of one or more panels relative to the frame is structural integrity and/or security of the panels relative to the frame. While in certain circumstances, allowing the panel to move relative to the frame is desirable, in other circumstances, not allowing the panel to move relative to the frame is desirable for the purpose of preventing undesired access through the panel. Means for providing these separate functionalities, however, can be incompatible with one another, and the means employed to provide both functions often involve tradeoffs that reduce the effectiveness of both functions.

There is, therefore, also a need for a sealing and/or locking system that effectively allows both a panel to move relative to the frame and also to selectively prevent movement of the panel relative to the frame. There is also a need for a sealing and/or locking system that can be employed between a frame and panel that prevents the transfer from one side of the panel to the other side of the panel such environmental effects as noise, weather, water, heat/cold, and insects.

BRIEF SUMMARY OF THE INVENTION

Embodiments of the invention address deficiencies of the art with respect to effectively creating a seal between a panel and a frame. A combined sealing system comprises a frame, a panel, a first sealing system, a second sealing system, and a third sealing system. The panel is within and movable, relative to the frame, between at least an open position and a completely closed position, and the panel includes a plurality of subpanels hinged relative to one another. The first sealing system is configured to engage a sill rail of the panel with a sill of the frame. The second sealing system is configured to engage a stile rail of the panel with a jamb of the frame. The third sealing system is configured to engage a meeting rail of the first panel with a header of the frame. In the closed position, the first and second sealing systems movable between a locked configuration and an unlocked configuration. The panel is also a garage door.

In further aspects, a first transfer system is provided to connect the first sealing system to the second sealing system. The first transfer system transfers rotational motion within the second sealing system into linear motion within the first sealing system. The first transfer system includes a drive link connected to the first drive shaft; a coupling link connected to a first movable member of the first sealing system; a stationary pin about which the coupling link pivots, and the drive link is pivotally connected to the coupling link.

In additional aspects, a second transfer system may also be included that connects the second sealing system to the third sealing system. The second transfer system transfers rotational motion within the second sealing system into rotational motion within the third sealing system. The rotational motion within the second sealing system is about a first axis, and the rotational motion within the third sealing system is about a second axis with first axis substantially perpendicular to the second axis. The second transfer system includes a frame portion and a panel portion, and the frame portion is disengaged from the panel portion in the open position. The frame portion is attached to the frame, and the panel portion is attached to the panel.

In yet further aspects, the first sealing system includes a plurality of pins extending from the frame; and a first movable member, within the frame, including a plurality of slots. In the closed position the first movable member is movable between a first, unlocked position and a second, locked position, and individual ones of the plurality of pins extend through individual ones of the plurality of slots. The first movable member is positioned within the sill of the frame, and the first movable member linearly moves along a plane substantially parallel to the sill of the frame. The slot includes a first portion having a narrower width and a second portion having a wider width, the pin includes a recess, and the second portion of the slot is configured to be inserted within the recess.

In yet additional aspects, the second sealing system includes a second movable member positioned within the frame and rotatable relative to the frame; and a drive member positioned within the frame and engaging the second movable member. Engagement of the drive member with the movable member pivots the movable member between an unengaged position and an engaged position. In the locked configuration, the second movable member in the engaged position prevents movement of the panel along a direction substantially parallel to a jamb of the frame.

In yet further aspects, the third sealing system includes a third movable member attached to the panel with the third movable member being rotatable relative to the panel; and a biasing member connected to the third movable member. Prior to the panel being positioned into the closed position, the third movable member engaging the frame. In the closed position, the biasing member structured to be releasable thereby decreasing a force being exerted by the third movable member against the frame.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1A:
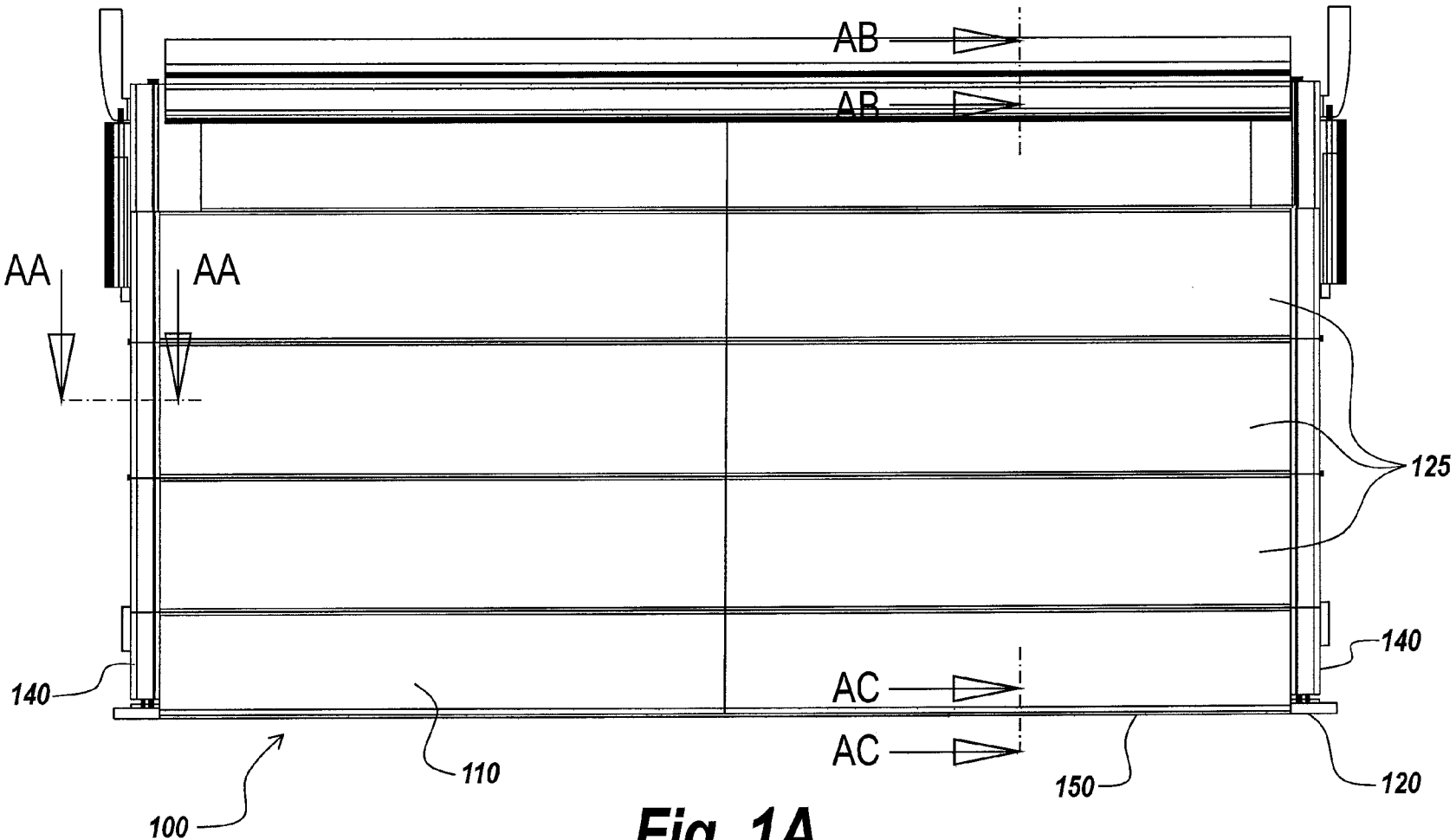
FIGS. 1A-1C are, respectively, front, top, and side views of a door/window system in accordance with the inventive arrangements.
Figure 1B:
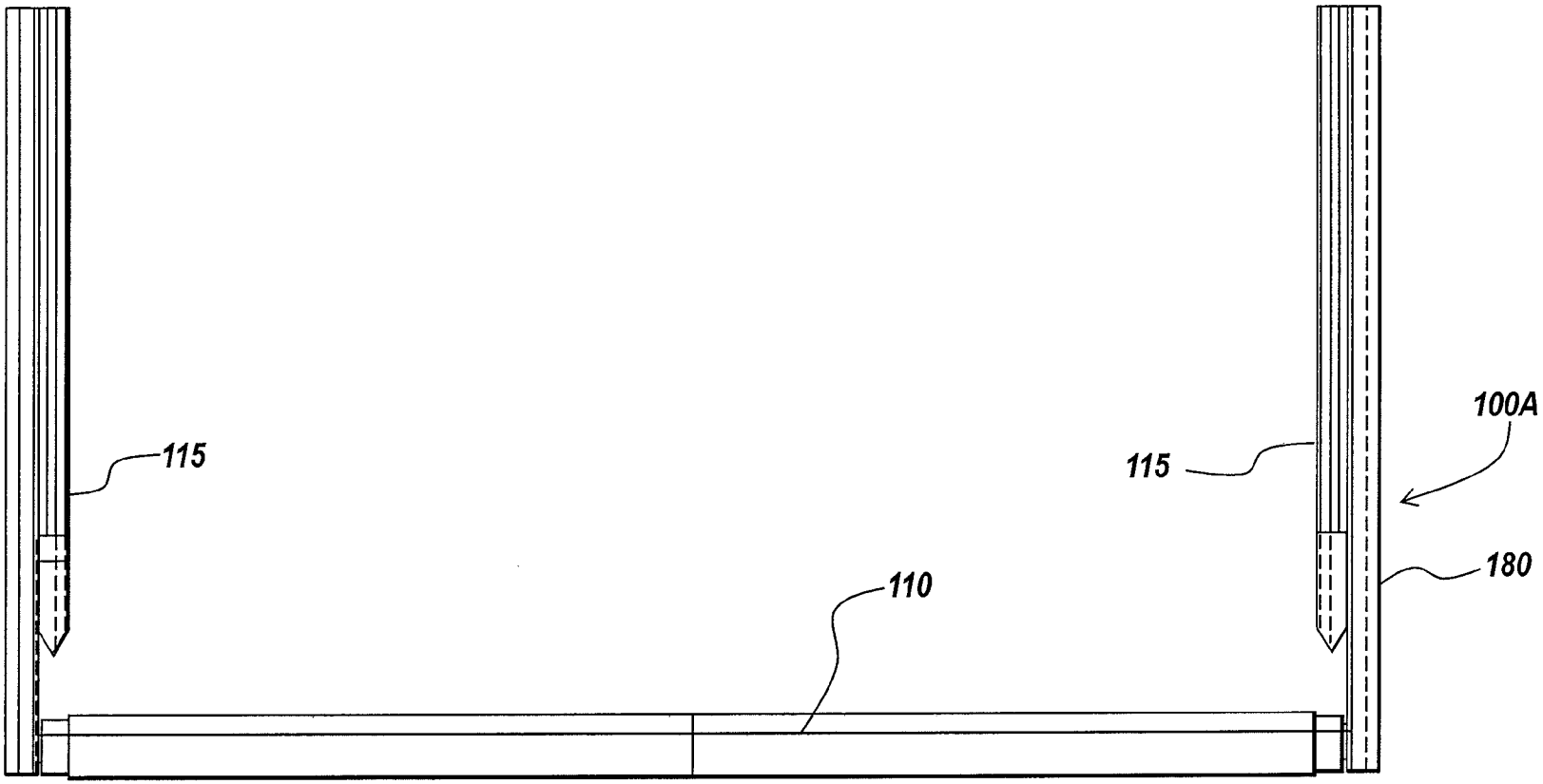
Figure 1C:
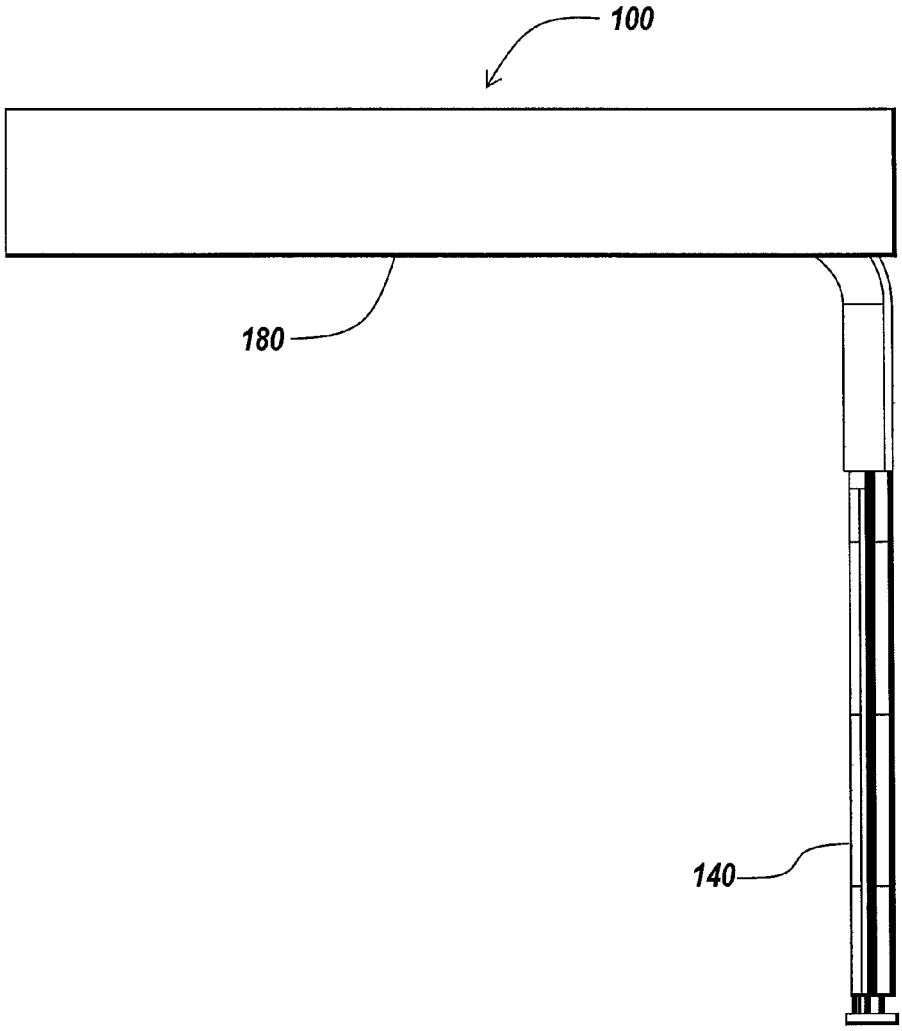

FIGS. 1A-1C illustrate an exemplar door/window system 100 for use with an improved sealing system 200 and combination of sealing systems 200A, 200B, 200C. The sealing systems 200A, 200B, 200C can be used with many types of doors and/or windows, and the sealing systems 200A, 200B, 200C are not limited to the particular door/window system 100 illustrated. For example, the sealing systems 200A, 200B, 200C may be used with pocket doors, sliding doors, French doors, entry doors, garage doors, sliding windows, single-hung windows, double-hung windows, casement windows, and awning windows. The door/window system 100 includes at least one panel 110 connected to and movable relative to a stationary frame 120. However, in certain aspects of the door/window system 100, the at least one panel 100 comprises multiple subpanels 125, which may be hinged relative to one another. An example of such a panel 110 is a garage door.

The door/window system 100 is not limited in the manner in which the panel 110 moves relative to the frame 120. For example, the panel 110 may move relative to the frame 120 along a plane parallel to a longitudinal axis of one of the surfaces (e.g., the header 130, jambs 140, or sill 150) of the frame 120 and/or substantially along a plane defined by the panel 110. In still further aspects of the door/window system 100, the panel 110 may change the plane along which the panel 110 moves.

The frame 120 may include a header 130 (see FIGS. 5A-5B), jambs 140, and a sill 150. A header 130 is a structural member that spans an upper portion of the window/door opening. Jambs 140 are the outermost vertical side members of the frame 120. A sill 150 is a threshold or structural member that spans a lower-most portion of the window/door opening. As recognized by those skilled in the art, different terms may also be associated with the above-structures identified as the header 130, jambs 140, and sill 150.

Each panel 110 and each subpanel 125 may include a sash that surrounds a pane. The pane is not limited as to a particular material. For example, the pane may be translucent, such as glass or plastic, opaque, such as with wood or metal, or any combination thereof. The sash may include a header rail, jamb or stile rails, and a sill rail. As recognized by those skilled in the art, different terms may also be associated with the structure identified as the header rail, the jamb or stile rail, and sill rail.

The sealing systems 200A, 200B, 200C (see FIGS. 2A-2C, 3A-3C, 5A-5B) may be used with each of the members of the sash to form a seal between each pair of adjacent surfaces of the sash of the panel 110 and the frame 120. In this manner, each of the separate sides of the panel 110 may employ one or more of the sealing systems 200A, 200B, 200C. As will be described in more detail below, not only does an individual sealing system 200 provide at least one seal between adjacent members of sash and frame, each of the sealing systems 200 may be employed to prevent the movement of the 110 panel relative to the frame 120. In so doing, the sealing systems 200 can act as a lock and/or security device that prevents the forced opening of the panel 110 relative to the frame 120. Many types of sealing systems 200 so capable are known in the art, and the present door/window system 100 is not limited as to a particular type of sealing system 200. In addition, the present door/window system 100 may employ one or more different types of sealing systems 200A, 200B, 200C.

Although the present door/window system 100 is described herein with particular types of sealing systems 200 being positioned in particular locations, the door/window system 100 is not limited as to a particular type of sealing system 200 or a particular location of the sealing system 200. For example, a sealing system 200 may be positioned within the frame 120 and/or the sash 160.

To prevent the forced opening of the panels 110, the sealing systems 200 are not limited as to a percentage of coverage between particular members of the frame 120 and/or panels 110. For example, each sealing system 200 may only cover a fractional number (e.g., 10%, 50%, 85%) of the length between particular members of the frame 120 and/or panel 110. However, in certain aspects, each sealing system 200 provides substantially complete coverage between the sash of a panel 110 and the frame 120. In so doing, the combined sealing systems 200A, 200B, 200C can provide a seal substantially completely around the panel 110.

Side Active Sealing Mechanisms

Figure 2A:
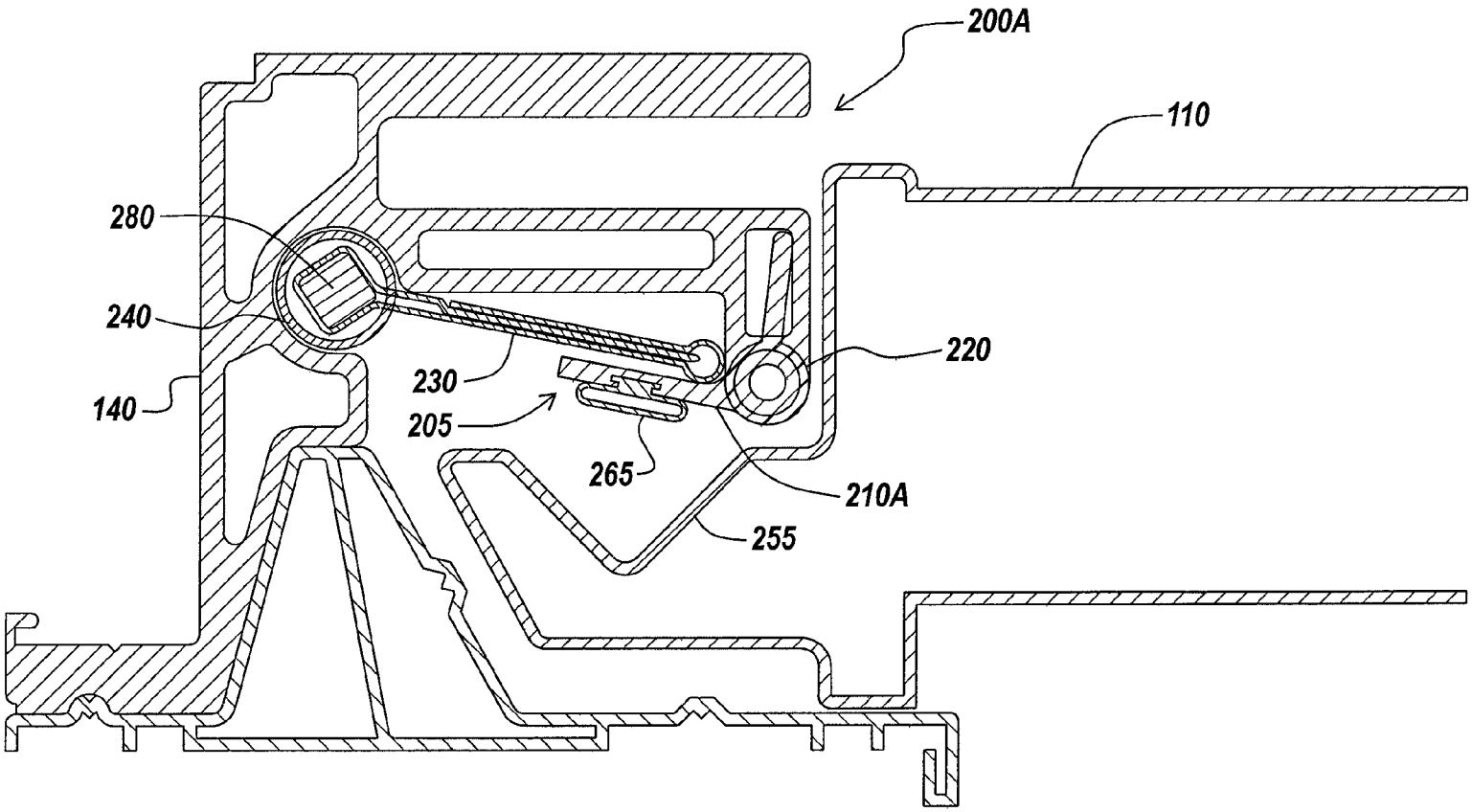
FIGS. 2A-2C are cross-sectional views of a sealing system positioned in a jamb and sash of the door/window system, respectively, in the closed and unlocked, partially locked, and locked configurations, in accordance with the inventive arrangements.
Figure 2B:
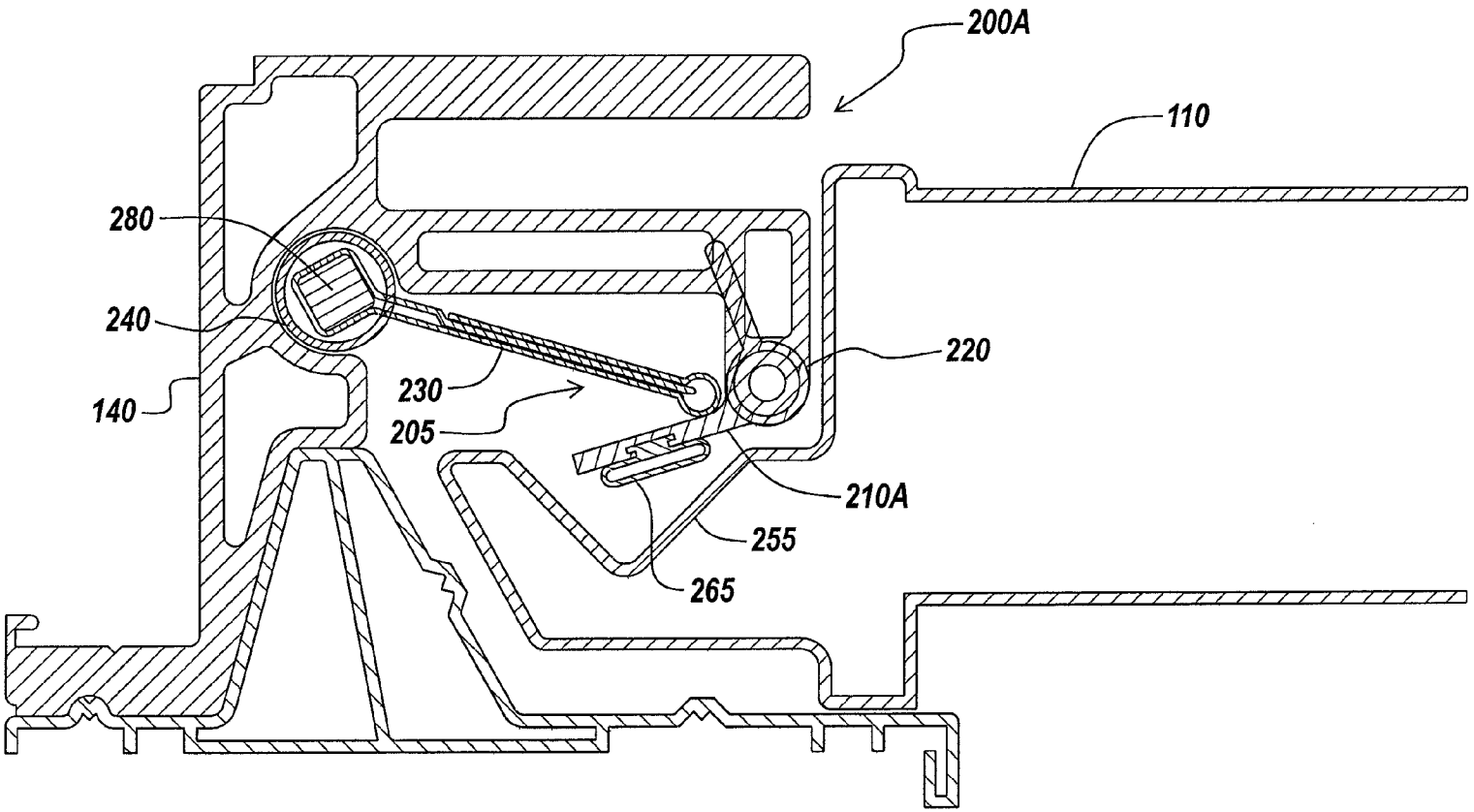
Figure 2C:
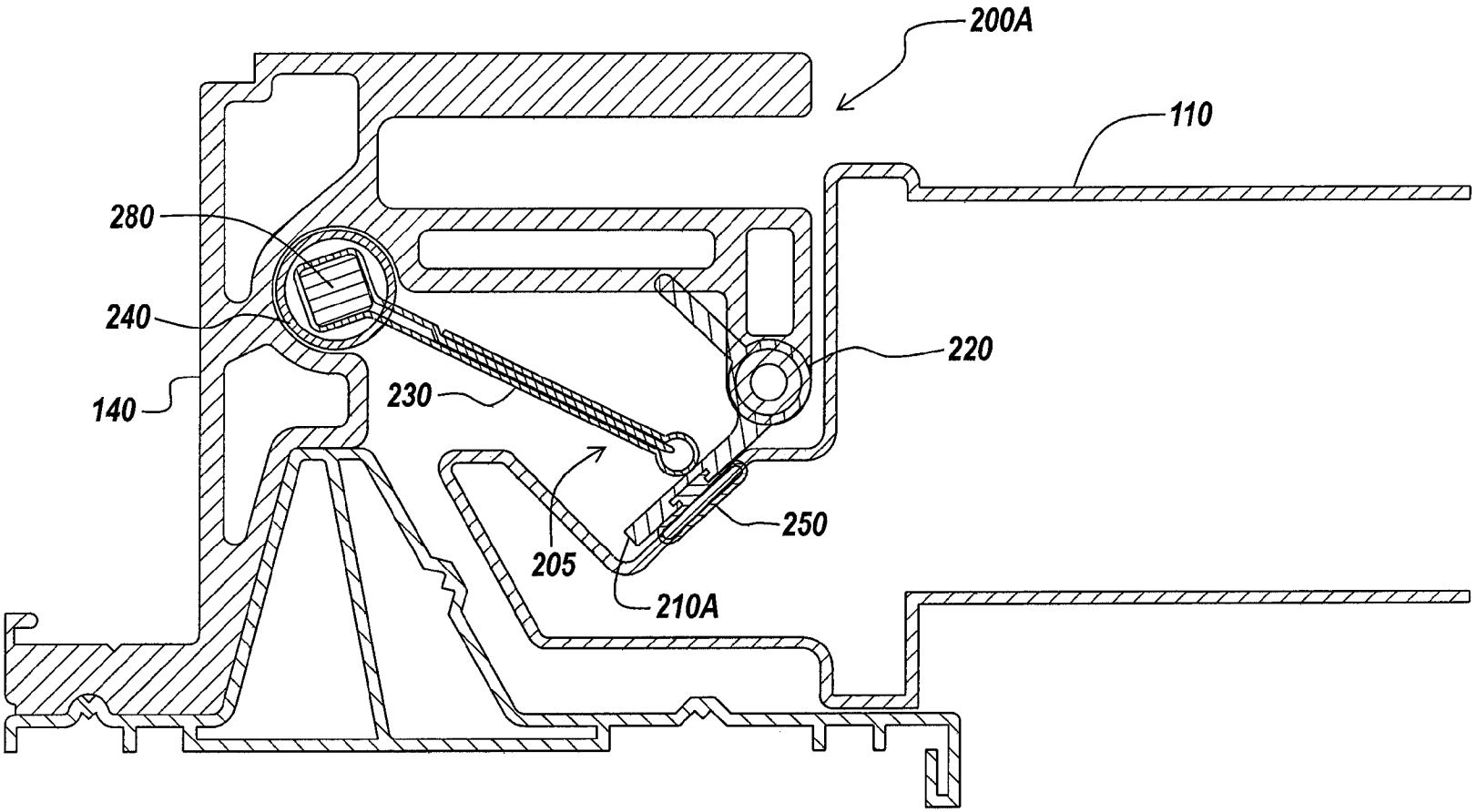
Figure 3A:
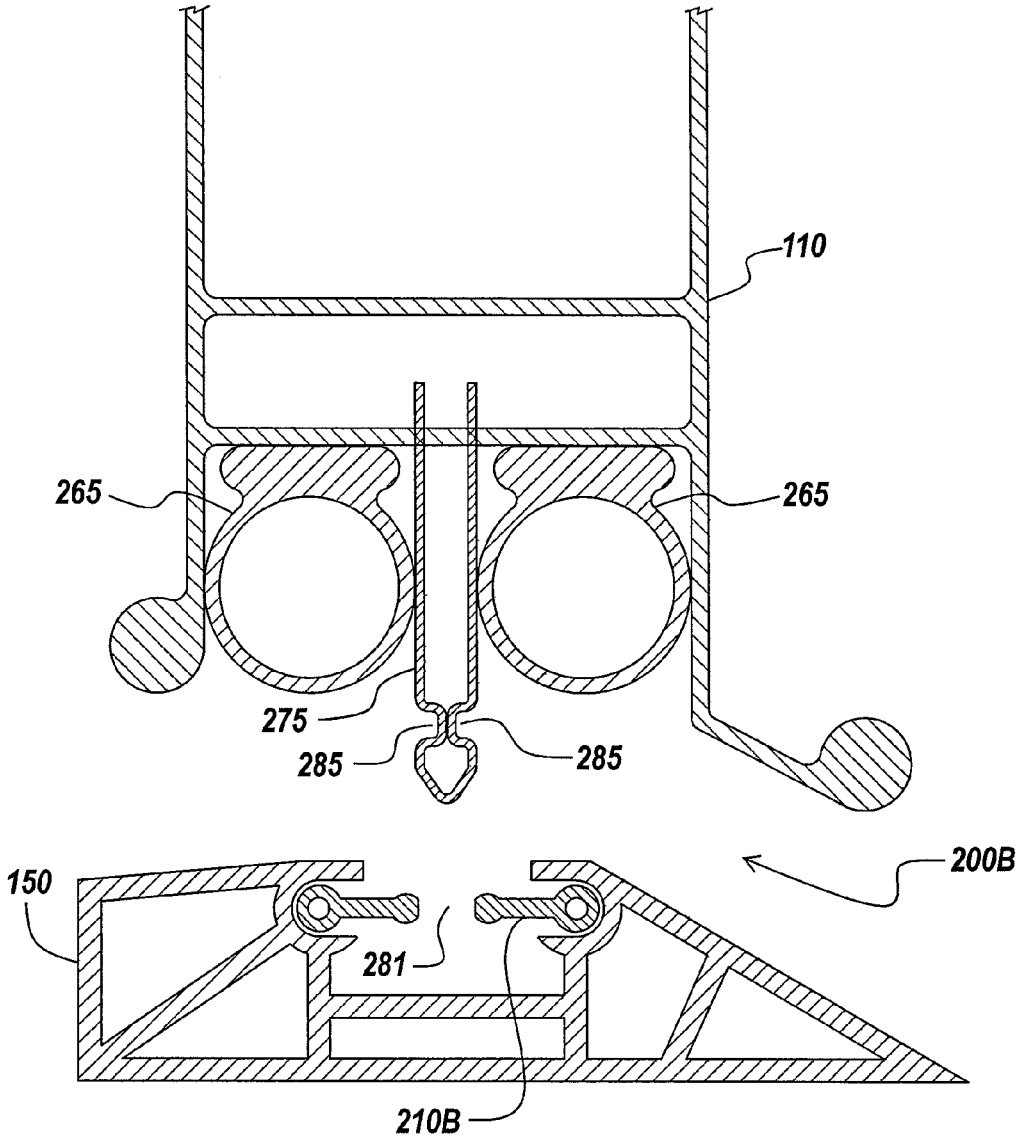
FIGS. 3A-3C are cross-sectional views of a sealing system positioned in a sill and sash of the door/window system, respectively, in the open, closed and unlocked, and locked configurations, in accordance with the inventive arrangements.
Figure 3B:
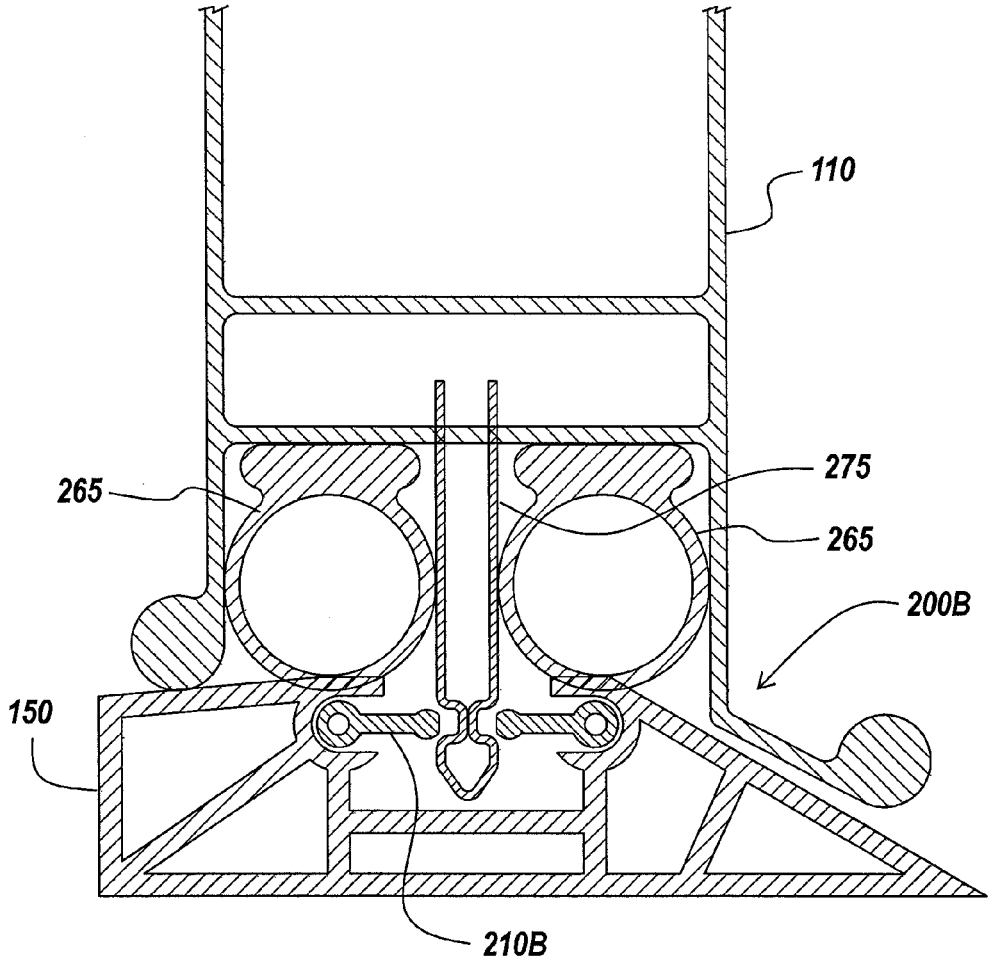
Figure 3C:
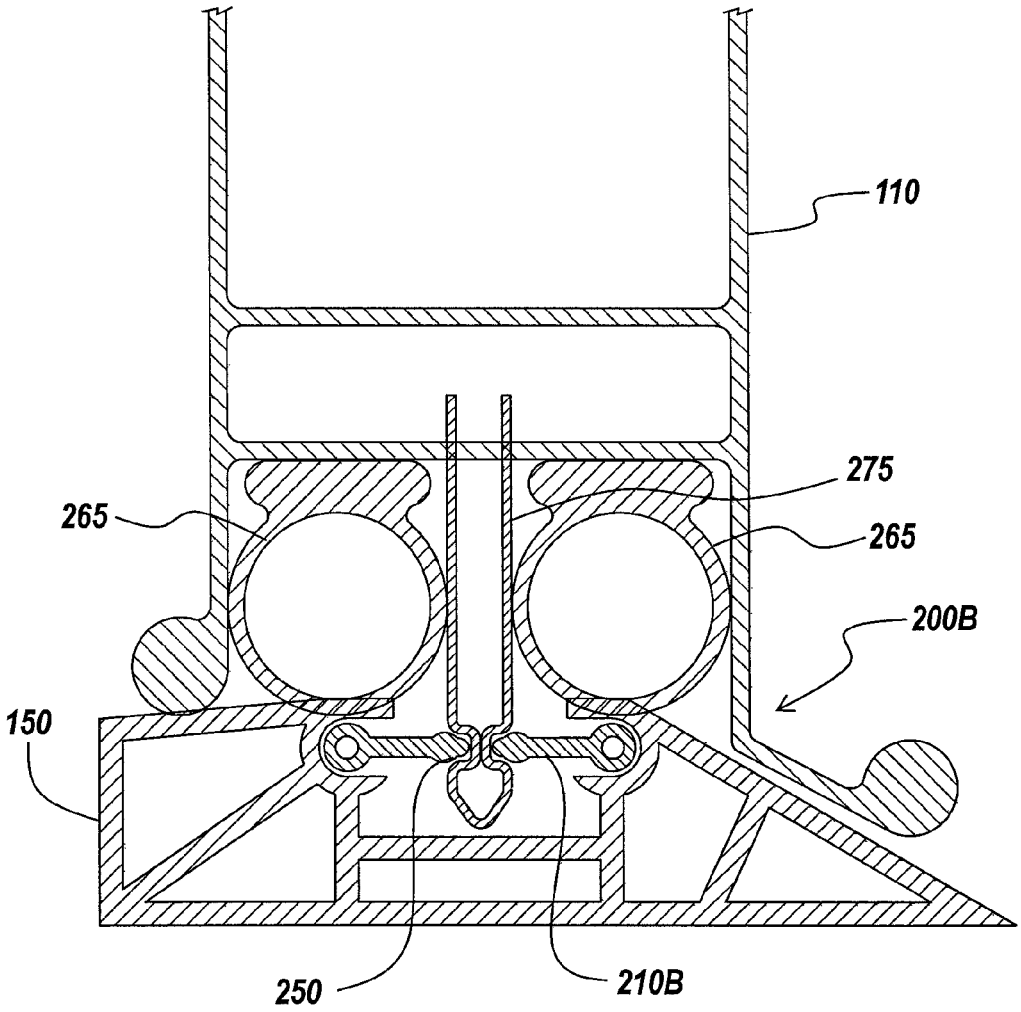

Referring to FIGS. 2A-2C, a sealing system 200A for use in the door/window system 100 is illustrated. Upon the panel 110 being disposed in the closed position, the sealing system 200A includes an active seal 205 that has a locked configuration and an unlocked configuration while the panel 110 is disposed in the closed position.

The active seal 205 operates by having a movable member 210A, disposed in the jamb 140, engage a stationary or movable portion of the sash of the panel 110. In certain aspects of the active sealing system 200A, as illustrated, the movable member 210A is positioned in the jamb 140 of the frame 120 and engages a stationary face 255 on the sash of the panel 110.

In certain aspects of the sealing system 200A, the active seal 205 can create a seal 250 between the movable member 210A and the opposing face 255. The movable member 210A and/or opposing face 255 may include passive seals 265 on one or both surfaces. The active seal 205 is not limited in the manner by which the movable member 210A engages the opposing face 255. For example, the movable member 210A may operate as a linearly-traveling piston. However, in certain aspects of the active seal 205, the movable member 210A (hereinafter referred to as seal gate 210A) pivots about a seal pivot 220. The manner by which the seal gate 210A is driven in not limited. For example, the seal gate 210A may be directly driven, for example, at the seal pivot 220. Alternatively, in certain aspects of the active seal, the seal gate 210A is driven using a drive gate 230 that causes the seal gate 210A to rotate about the seal pivot 220.

Although not limited in this manner, the drive gate 230 pivots about a drive pivot 240 and is itself driven by a drive system 300 (see discussion with regard to FIGS. 4A-4B and 6A-6B). By using leverage generated by these inter-engaging levers 210A, 230, the active seal 205 is capable of exerting significant force against the sill. In so doing, a seal 250 between the movable member 210A and the opposing face 255 can be created and/or enhanced. Additionally, the active seal 205 can prevent movement of the panel 110 relative to the frame 120.

Lower Sealing Mechanism

Referring to FIGS. 3A-3C and 4A-4C, another configuration of a sealing system 200B for use in the door/window system 100 is illustrated. Upon the panel 110 being disposed in the closed position (e.g., FIGS. 3B-3C), the sealing system 200B also includes a movable member 210B that is driven by a drive system 300 from a first, unlocked position to a second, locked position to form a seal 250 between, for example, adjacent members of sash and the sill 150 of the frame 120. Although not limited in this manner, one or more compressible passive seals 265 may be positioned between the sill 150 of the frame 120 and the sash of the panel 110. As the panel 110 is disposed in the closed position, these passive seals 265 may be compressed, thereby creating a seal between the sill 150 of the frame 120 and the sash of the panel 110.

In certain aspects of the sealing system 200, the seal 250 is formed by engagement of the movable member 210B positioned on one of the frame 120 and sash 160 with another feature positioned on the other of the frame 120 and sash 160. However, in certain aspects of the sealing system 200, the movable member 210B is disposed in the frame 120 and engages a portion of the sash 160 of the panel 110.

Although not limited in this manner, the movable member 210B may engage one or more pins 275 extending from the sash of the panel 110. As the panel 110 is positioned within the closed position, the pin 275 passes through a slot 281 within the movable member 210B. The slot 281 may have widths. Within the portion of the slot 281 having a wider width, the pin 275 can be inserted into and withdrawn from the slot 281 without interference. The slot 281 also has a portion having a narrower width which is dimensioned to be less than a diameter of a portion of the pin 275.

Once in the closed position, the movable member 210B moves relative to the pin 275 and positions a portion of the movable member 210B within a recess 285 of the pin 275. The portion of the movable member 210B positioned with the recess 285 corresponds to the portion of the slot 281 having the narrower width. Upon the movable member 210B being positioned within the recess 285 (see FIG. 3C), the pin 275 is prevented from being withdrawn from the movable member 210B. In this manner, the panel 110 may be prevented from moving relative to the frame 120.

Figure 7A:
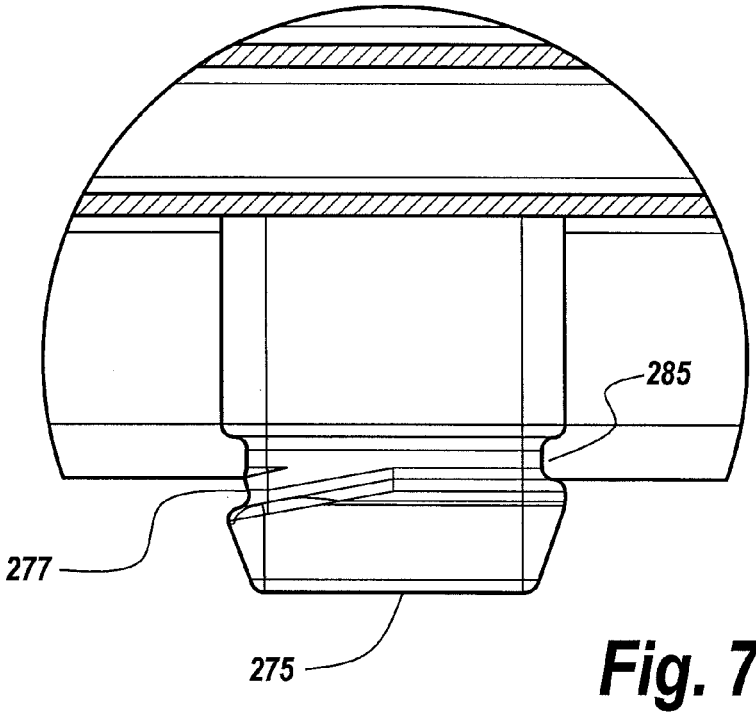
FIGS. 7A-7B are side views of pin respectively with and without a ramped step.
Figure 7B:
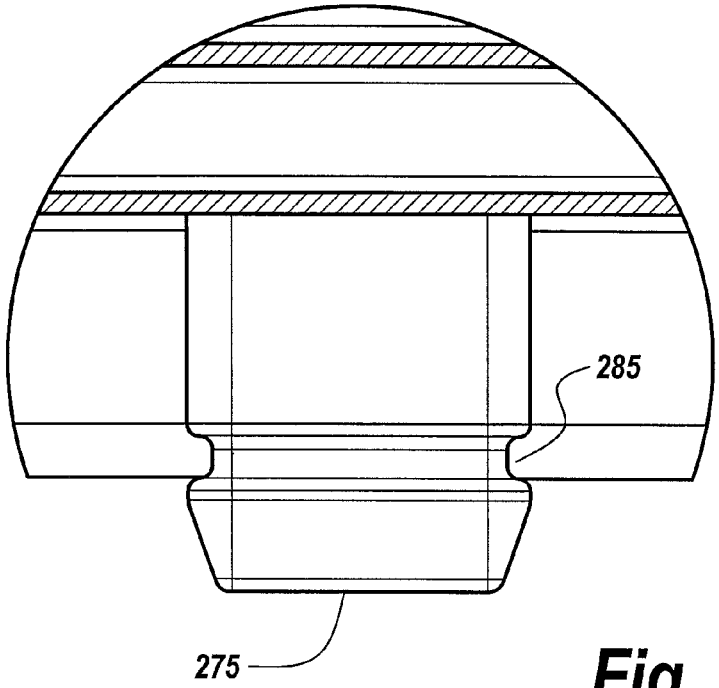

Referring to FIGS. 7A-7B, the pins 275 may have different configurations. For example, referring to FIG. 7A, the pin 275 may include a ramped step 277 on the side of the pin 275 that faces the narrower portion of the slot 281. Although shown at the bottom of the pin, the ramped step may also be positioned on the top of the pin 275. The ramped step 277 widens the recess 285 of the pin 275, which permits a greater tolerance in aligning the panel 110 relative to the frame 120 prior to engaging the sealing systems 200A, 200B, 200C. As the movable member 210B moves relative to the pin 275, if the pin 275 (and thus the panel 110) is misaligned, the movable member 210B may engage the ramped step 277, which moves the panel 110 into proper alignment with the movable member 210B, and thus, the frame 120. Alternatively, referring to FIG. 7B, no ramped step may be provided.

Upper Sealing Mechanism

Figure 5A:
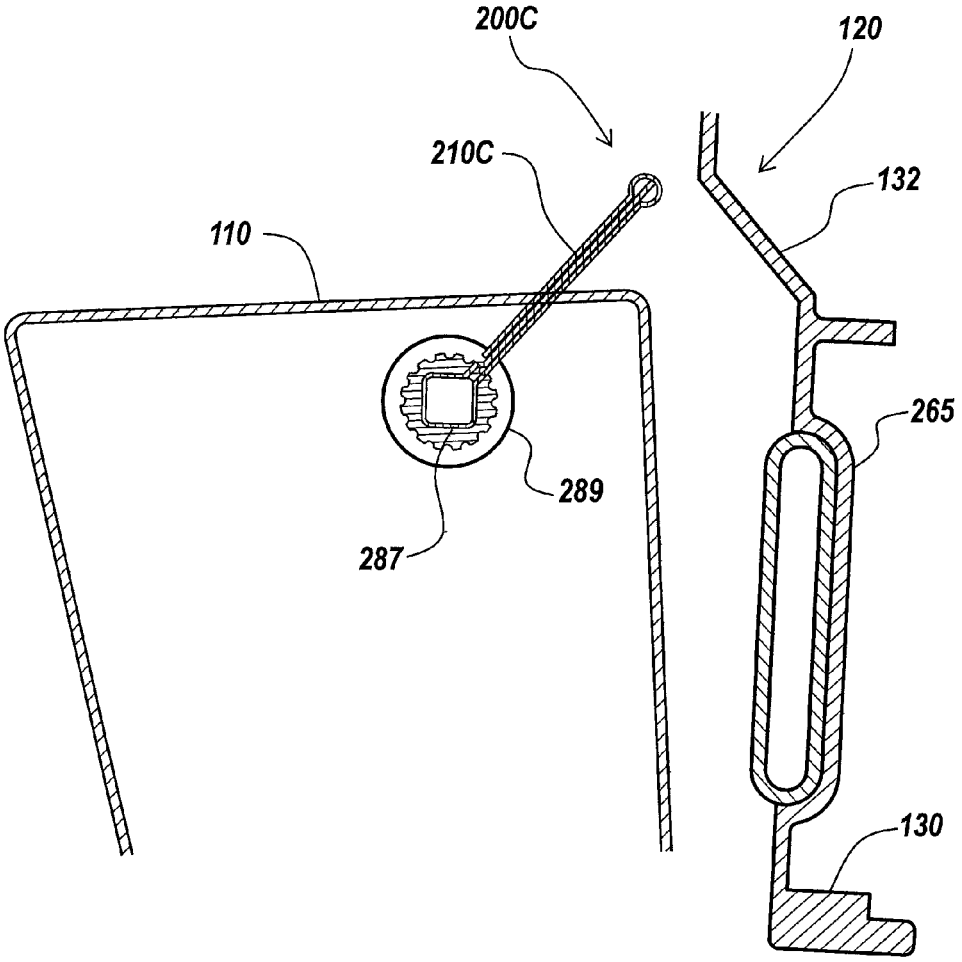
FIGS. 5A-5B are cross-sectional views of a sealing system positioned in a header and sash of the door/window system, respectively, in the open and locked configurations, in accordance with the inventive arrangements.
Figure 5B:
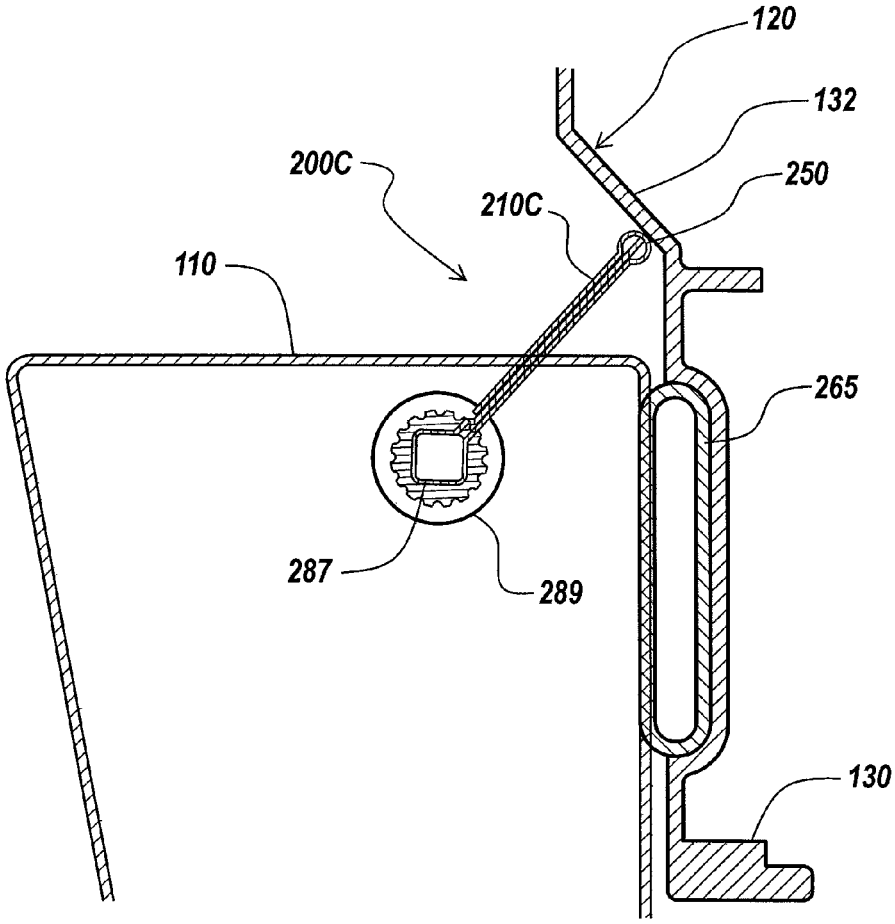

Referring to FIGS. 5A-5B, yet another configuration of a sealing system 200C for use in the door/window system 100 is illustrated. Upon the panel 110 being disposed in the closed position (i.e., FIG. 5B), a movable member 210C attached to the panel 110 engages a portion of the header 130 of the frame 120 to form a seal 250 there between. A passive seal 265 may also be provided between the header 130 and the panel 110.

As the panel 110 moves from the open position (i.e., FIG. 5A) into the closed position, the movable member 210C drags along and engages a portion 132 of the header 130. Although not limited in this manner, the movable member 210C may be connected to a biasing member 289 (e.g., a spring). As the movable member 210C engages the portion 132 of the header 130, the biasing member 289 is biased.

After the panel 110 has been positioned within the closed position of the panel 110 relative to the frame 120, second drive shaft 287 drives the movable member 210C against the header 130, thereby increasing a force being exerted by the movable member 210C against the header 130. When the sealing system 200C is to be unlocked, the stored energy within the biasing member can be released, the result of which is to reduce the force being exerted by the movable member 210C against the header 130.

Seal Drive Mechanisms

Referring to FIGS. 4A-B and 6A-6B, a drive system 300 for use in the door/window system 100 is illustrated. The drive system 300 moves the sealing systems 200A, 200B, 200C from the unlocked configuration (e.g., FIGS. 2A-2B, 3A-B, 4A, 5A, 6A) to a locked configuration (e.g., FIGS. 2C, 3C, 4B, 5B, 6B). The drive system 300 may also move the sealing systems 200A, 200B, 200C from the locked configuration to the unlocked configuration. In certain aspects, the drive system 300 is configured to simultaneously move each of the separate sealing systems 200A, 200B, 200C. In other aspects of the door/window system 100, however, multiple drive systems 300 may be employed to separately close one or more of the individual sealing systems 200A, 200B, 200C.

The manner in which the drive system 300 moves the sealing system 200 from the unlocked configuration to the locked configuration (and back again) is not limited as to a particular methodology and/or device. As can be readily envisioned, the configuration and operation of the drive system 300 may be determined by the configuration and operation of the sealing systems 200A, 200B, 200C. The drive system 300 may be driven with a manual device. However, other devices capable of driving a sealing system 200 are commonly known, such as a pneumatic, hydraulic, magnetic, mechanical, and electro-mechanical devices. A combination of these devices may also be used.

Referring to FIGS. 2A-2C and as previously described, one of the sealing systems 200 employs a drive gate 230, which urges a movable member 210A against an opposing face 255 to form a seal between the jamb 140 and panel 110. Any drive system 300 capable of driving the drive gate 230 in this manner is acceptable for use with the present door/window system 100. In a present aspect of the door/window system 100, the drive gate 230 is connected drive shaft 280 at the seal pivot 220, and the drive shaft 280 is connected, either directly or indirectly, to other drive members of the drive system 300. As the drive shaft 280 is rotated, the drive gate 230 also rotates and engages the movable member 210A.

Transfer System

Referring to FIGS. 4A-4B and 6A-6B, transfer systems 290, 295 for use in the door/window system 100 is illustrated. The transfer systems 290, 295 each transfer motion, such as rotation and linear, from one drive system 300 to another drive system 300. In so doing, the motion generated by a single drive system 300 is capable of driving two or more sealing systems 200 located on different edges of the frame 120 and sash through the use of one or more transfer systems 290, 295. Alternatively or, in addition to a single drive system 300 driving two or more sealing systems 200, as previously discussed, multiple drive systems 300 can each separately drive one or more sealing systems 200.

Figure 4A:
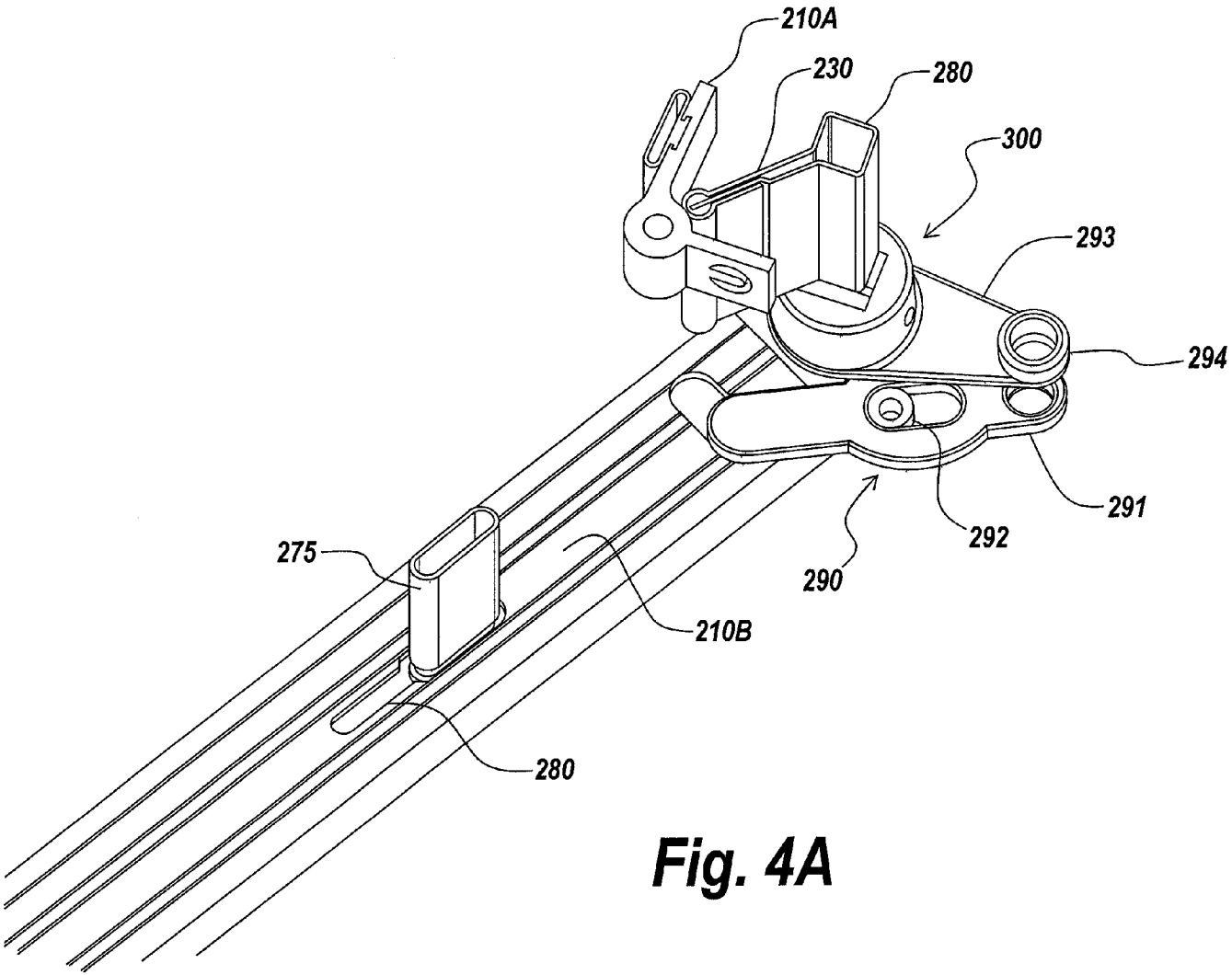
FIGS. 4A-4C are perspective views of drive and transfer systems positioned between the sealing systems within the jamb and sill of the frame, in accordance with the inventive arrangements.
Figure 4B:
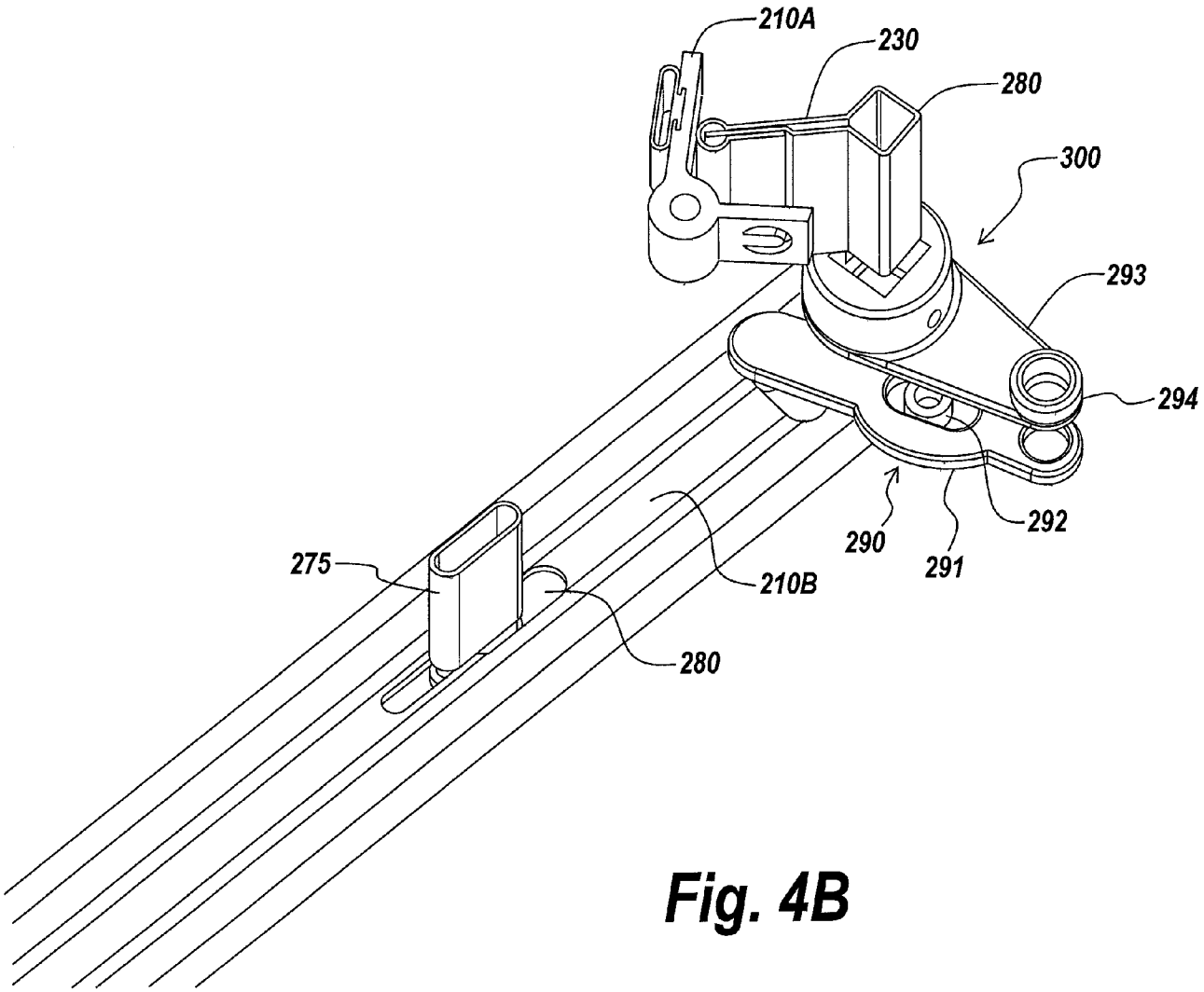
Figure 4C:
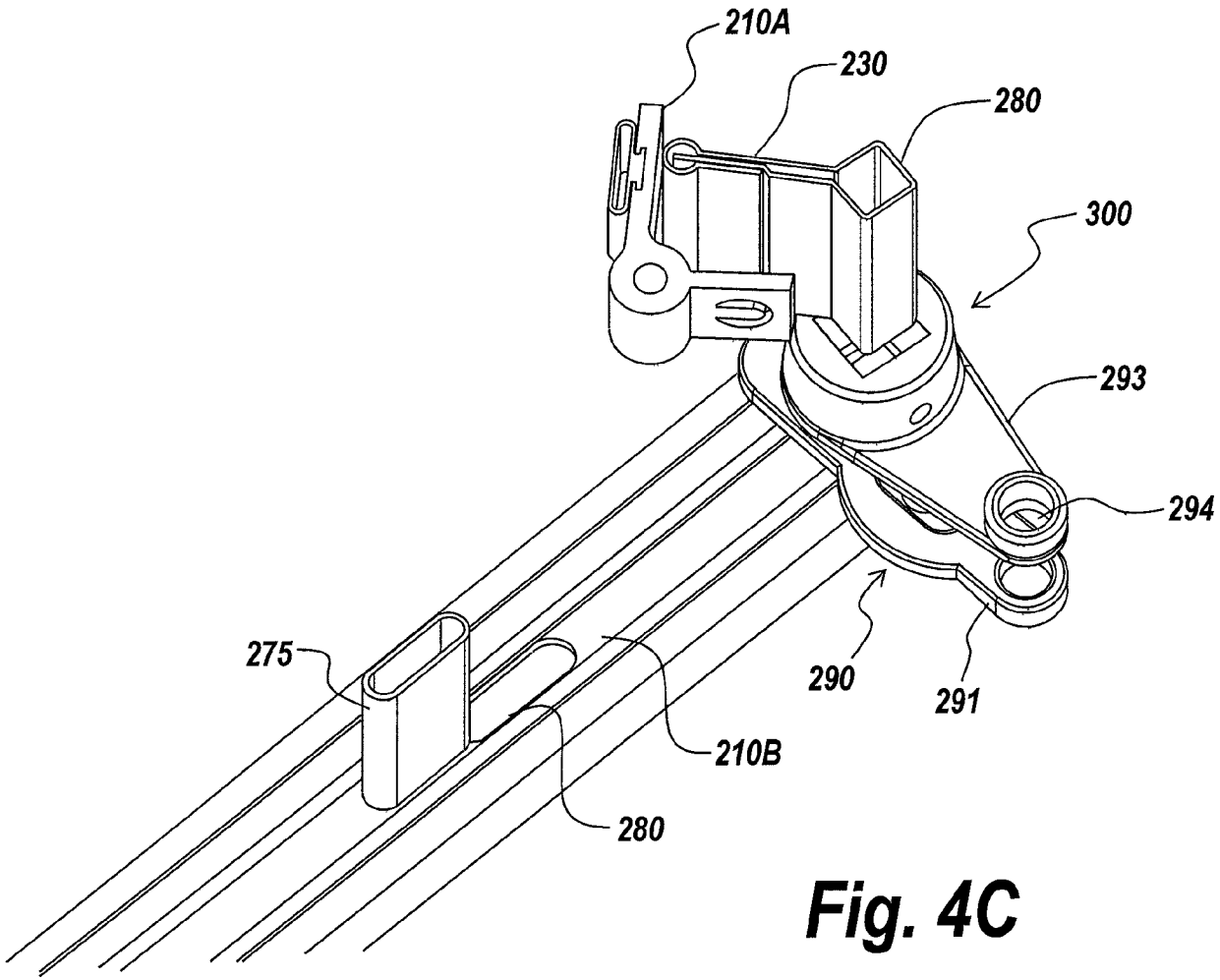

Many types of transfer systems are capable of transferring motion from one drive system 300 to another drive system 300, and the door/window system 100 is not limited as to a transfer system 290, 295 so capable. For example, as illustrated in FIGS. 4A-4B, the transfer system 290 transfers rotational movement of a first drive shaft 280 of one of the drive systems 300 into linear motion of the movable member 210B of the lower sealing system 200A.

Although not limited in this manner, the transfer system 290 includes a pair of links 291, 293 attached to one another about a pivot 296. The drive link 293 is attached to the first drive shaft 280, and the coupling link 291 is attached to the movable member 210B. The coupling link 291 also rotates about a stationary pin 292. As the first drive shaft 280 rotates, the movable member 210B moves along a plan substantially parallel to the sill 150 of the frame 120.

Figure 6A:
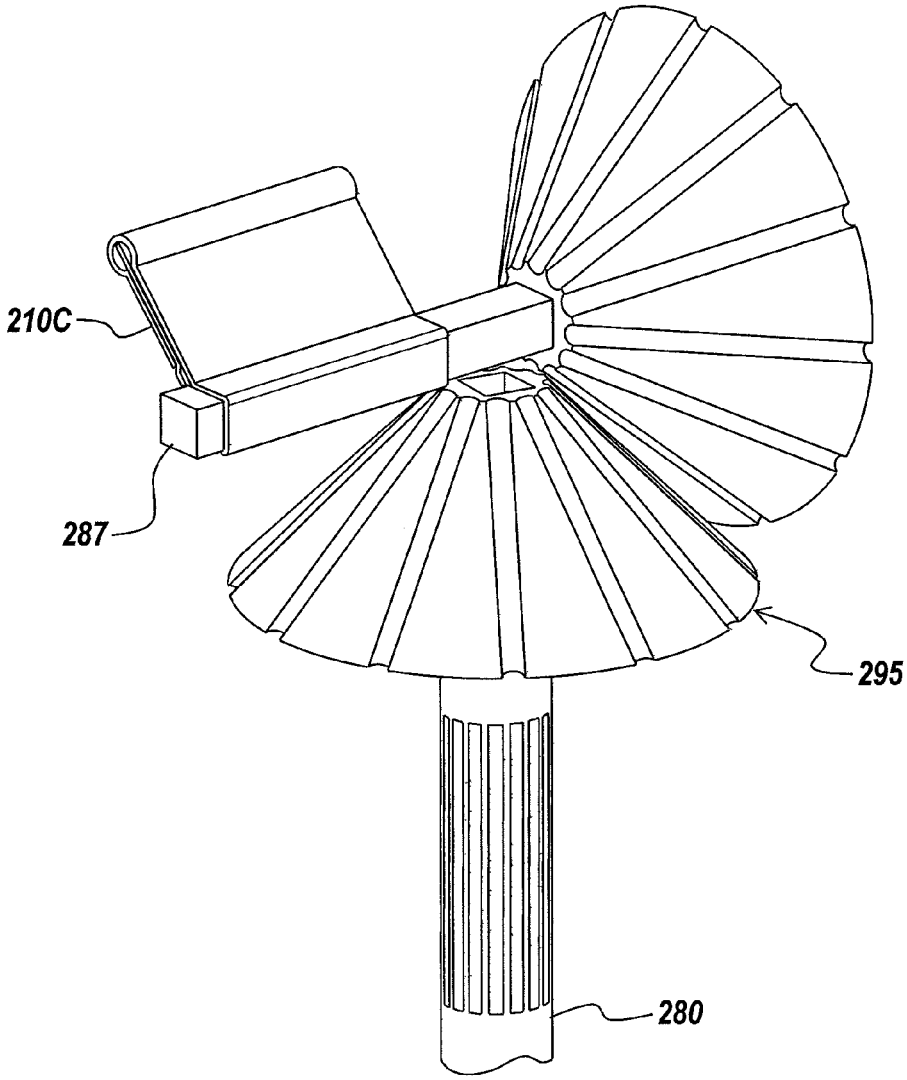
FIGS. 6A-6B are perspective views of the drive and transfer systems positioned between the sealing systems within the jamb and header of the frame, in accordance with the inventive arrangements.
Figure 6B:
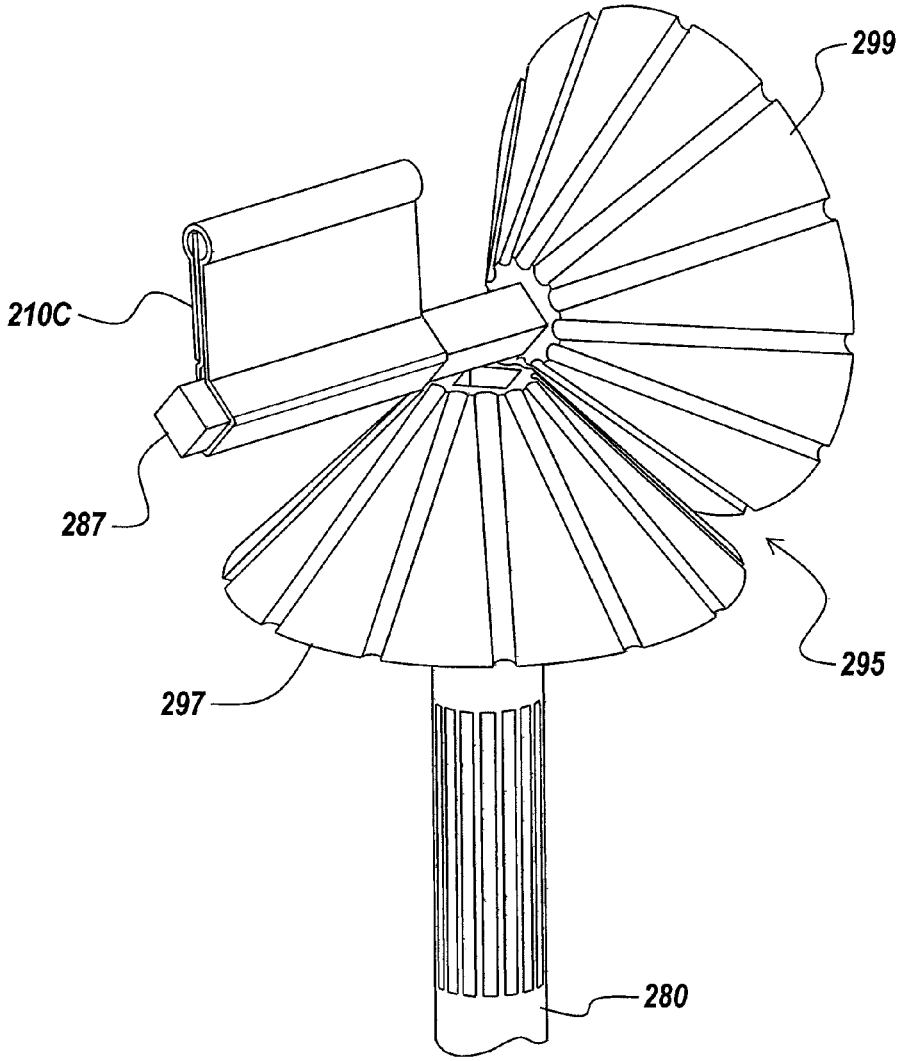

Referring to FIGS. 6A-6B, the transfer system 295 transfers rotation movement, along a first axis, of a first drive shaft 280 of one of the drive systems 300 into rotational movement, along a second axis, of a second drive shaft 287 of the upper sealing system 200C. In certain aspects, the transfer system 295 includes a frame portion and a panel portion. The frame portion (e.g., first drive shaft 280 and first conical gear 297) is stationary relative to the frame 120, and the panel portion (e.g., second drive shaft 287 and second conical gear 299) is attached to and moves with the panel 110. As the panel 110 moves from the closed position to the open position relative to the frame 120, the frame portion of the transfer system 295 disengages from frame portion of the transfer system 295. Similarly, as the panel 110 moves from the open position to the closed positioned relative to the frame 120, the frame portion of the transfer system 295 engages the frame portion of the transfer system 295.

As is recognized by those skill in the art, many different mechanisms can be used to transfer rotational movement along one axis to rotational movement along another axis or rotational movement to linear movement, and the door/window system 100 is capable of using any transfer system so capable.

Drive Mechanisms

Many types of motive power is capable of being supplied to the drive systems 300, and the door/window system 100 is not limited as to a particular device or manner so capable. For example, a manual handle may be used to rotate one of the drive shaft (e.g., the first drive shaft 285). In addition to, or as an alternative to a handle, an electro-mechanical system may be provided to supply motive power to the drive systems 300. The electro-mechanical system is not limited in the manner in which the electro-mechanical system receives electrical power. For example, the electro-mechanical system may receive electrical power from a battery located within the frame 120 or the panel 110. In addition to, or alternatively, the electromechanical system may receive electrical power from line voltage via the structure in which the door/window system is installed.

What is claimed is:

1. A combined sealing system, comprising:

a frame;

a panel within and movable, relative to the frame, between at least an open position and a completely closed position, the panel including a plurality of subpanels hinged relative to one another;

a first sealing system configured to form a first seal between a sill rail of the panel and a sill of the frame;

a second sealing system configured to form a second seal between a stile rail of the panel and a jamb of the frame;

a third sealing system configured to form a third seal between a meeting rail of the panel and a header of the frame; and a first transfer system connecting the first sealing system to the second sealing system, wherein the first transfer system transfers rotational motion within the second sealing system into linear motion within the first sealing system, a second transfer system connecting the second sealing system to the third sealing system, wherein the second transfer system transfers rotational motion within the second sealing system into rotational motion within the third sealing system, the rotational motion within the second sealing system is about a first axis, the rotational motion within the third sealing system is about a second axis, and the first axis is substantially perpendicular to the second axis, and in the closed position, the first and second sealing systems are movable between a locked configuration and an unlocked configuration.

2. The combined sealing system of claim 1, wherein the panel is a garage door.

3. The sealing system of claim 1, wherein the first transfer system includes a drive link connected to a first drive shaft;

a coupling link connected to a first movable member of the first sealing system;

a stationary pin about which the coupling link pivots, wherein the drive link is pivotally connected to the coupling link.

4. The combined sealing system of claim 1, wherein the second transfer system includes a frame portion and a panel portion, and the frame portion is disengaged from the panel portion in the open position.

5. The combined sealing system of claim 4, wherein the frame portion is attached to the frame, and the panel portion is attached to the panel.

6. The combined sealing system of claim 1, wherein the second sealing system includes a second movable member positioned within the frame and rotatable relative to the frame;

a drive member positioned within the frame and engaging the second movable member; wherein the engagement of the drive member with the movable member pivoting the movable member between an unengaged position and an engaged position, in the locked configuration, the second movable member in the engaged position preventing movement of the panel along a direction substantially parallel to a jamb of the frame.

* * * * *